US009157201B2

(12) United States Patent
Fukano et al.

(10) Patent No.: US 9,157,201 B2
(45) Date of Patent: Oct. 13, 2015

(54) SNOW PLOW

(71) Applicant: HONDA MOTOR CO., LTD., Tokyo (JP)

(72) Inventors: Jun Fukano, Wako (JP); Tsutomu Mizoroke, Wako (JP); Shinsaku Nakayama, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 14/518,037

(22) Filed: Oct. 20, 2014

(65) Prior Publication Data

US 2015/0107134 A1 Apr. 23, 2015

(30) Foreign Application Priority Data

Oct. 23, 2013 (JP) ..... 2013-220510

(51) Int. Cl.
*E01H 5/04* (2006.01)
*E01H 5/09* (2006.01)

(52) U.S. Cl.
CPC . *E01H 5/098* (2013.01); *E01H 5/04* (2013.01)

(58) Field of Classification Search
CPC .... A01B 33/028; A01B 33/082; A01B 51/02; E02F 9/2004; E01H 5/00; E01H 5/04; E01H 5/09; E01H 5/098; B62D 51/004; B62D 51/04; B60K 1/02; B60L 3/08; B60L 15/18; B60L 15/20; B60W 10/08
USPC ..... 37/234–236, 244, 245, 247, 249, 257, 37/347, 348; 172/2–11; 180/19.2, 19.3, 180/68.2, 68.5, 183; 318/61, 64, 66, 139, 318/567; 701/22, 50, 70
See application file for complete search history.

(56) References Cited

U.S. PATENT DOCUMENTS 6,564,481 B2 * 5/2003 Wakitani ..... B60L 15/2036 180/19.3
6,977,473 B2 * 12/2005 Wakitani ..... B60K 1/02 318/61
7,997,016 B2 * 8/2011 Yamazaki ..... E01H 5/04 37/234

FOREIGN PATENT DOCUMENTS

JP S63-136012 9/1988
JP 2007-032218 2/2007

* cited by examiner

*Primary Examiner* — Robert Pezzuto
(74) *Attorney, Agent, or Firm* — Rankin, Hill & Clark LLP

(57) ABSTRACT

A snow plow includes a control unit for controlling a raising/lowering drive mechanism so that an auger housing becomes horizontal, a relative angle detection unit for detecting the angle of the auger housing relative to a travel frame, and a horizontal detection unit for detecting the horizontal state of the auger housing. The control unit stops the raising/lowering drive mechanism when the control unit assess that either a first condition or a second condition is satisfied, the first condition being that the relative angle be zero and the second condition being that the auger housing be horizontal.

1 Claim, 7 Drawing Sheets

SNOW PLOW

FIELD OF THE INVENTION

The present invention relates to a self-propelled snow plow having a travel device and an auger.

BACKGROUND OF THE INVENTION

In auger-type snow plows, an auger housing is mounted to a vehicle body frame including travel device, such that the auger housing can be raised and lowered and made to roll. The auger housing includes an auger. An auger snow plow can scrape up snow by means of a front auger while traveling forward, and can disperse the scraped up snow far away by means of a blower via a shooter.

A snow plow including an auger employs a system for varying the height of the auger housing in accordance with the conditions of the snow plowing work. It is more efficient to move the snow plow when the bottom surface of the auger housing has been raised. It is more efficient to plow snow when the bottom surface of the auger housing has been lowered. The height of the auger housing is also often varied according to unevenness in the road surface when snow is plowed.

It is highly inconvenient for a worker to make these variations to the height of the auger housing through manual labor. To alleviate the burden on the worker, the bottom surface of the auger housing can be raised and lowered with a power assist. This feature is disclosed in Japanese Utility Model Application Laid-Open Publication No. 63-136012 (JP-U-S63-136012) and Japanese Patent Application Laid-Open Publication No. 2007-032218 (JP-A-2007-032218).

In the snow plow disclosed in JP-U-S63-136012, the auger housing angle is used to control an angle of inclination detector provided to the auger housing to detect the angle of the auger housing relative to the direction of gravity.

In the snow plow taught in JP-A-2007-032218, the raised/lowered angle of the auger housing is controlled due to the angle of the auger housing relative to a travel frame having the travel device being detected by a height position sensor. When a reset switch is turned on by a worker, a control unit controls a raising/lowering drive mechanism so as to adjust the auger housing to a predetermined height reference position. The term "height reference position" refers to a position where the bottom end of a scraper included in the auger housing comes in contact with a flat surface (the traveled road surface) while the auger housing is in a horizontal state.

For example, when the travel device is traveling forward over an inclined surface; i.e., when the front is raised, the auger housing lowers so as to be horizontal. At this time, the auger housing could possibly come in contact with the upward inclined surface before becoming horizontal. The raising/lowering drive mechanism continues driving in order to make the auger housing horizontal. There is yet room for improvement in increasing the travel performance of the snow plow as well as increasing the durability of the snow plow.

In view of this, there is demand for a feature whereby travel performance and durability of the snow plow are increased.

SUMMARY OF THE INVENTION

According to the present invention, there is provided a snow plow comprising a travel frame having a travel device, an auger housing having an auger and capable of being raised and lowered relative to the travel frame, a raising/lowering drive mechanism for raising and lowering the auger housing, and a control unit for controlling the raising/lowering drive mechanism; wherein the snow plow comprises a relative angle detection unit for detecting the angle of the auger housing relative to the travel frame, and a horizontal detection unit for detecting the horizontal state of the auger housing relative to the direction of gravity; the control unit controls the raising/lowering drive mechanism so that the auger housing becomes horizontal; and the control unit performs a control so as to stop the raising/lowering drive mechanism when the control unit assess that either a first condition or a second condition is satisfied, the first condition being that the relative angle be zero and the second condition being that the auger housing be horizontal.

Thus, when the control unit controls the raising/lowering drive mechanism so that the auger housing becomes horizontal, the control unit stops the raising/lowering drive mechanism either when the relative angle is zero or when the auger housing is horizontal.

For example, when traveling forward over an upward-inclined road surface, the travel device takes on a front-raised orientation matching the upward-inclined road surface. The auger housing takes on a front-raised orientation together with the travel device. In this case, the raising/lowering drive mechanism lowers the auger housing from a front-raised orientation to a horizontal orientation. At this time, the auger housing could possibly come in contact with the upward-inclined surface before reaching a horizontal state.

The raising/lowering drive mechanism stops the auger housing when the angle of the auger housing relative to the travel frame is zero. In other words, the raising/lowering drive mechanism does not continue to drive until the auger housing reaches a horizontal state. Therefore, the travel device can be grounded more reliably on the upward-inclined surface. Because the travel device travels while reliably grounded on the upward-inclined surface, the travel performance of the snow plow can be improved. Moreover, because the auger housing does not continue to be lowered further until reaching a horizontal orientation after the relative angle has reached zero, the durability of the snow plow can be further increased.

When the travel device is traveling on a downward-inclined road surface, or is in other words in a front-lowered state, the auger housing is also in a front-lowered state. Therefore, the auger housing rises so as to be horizontal and stops upon becoming horizontal.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

Figure 1:
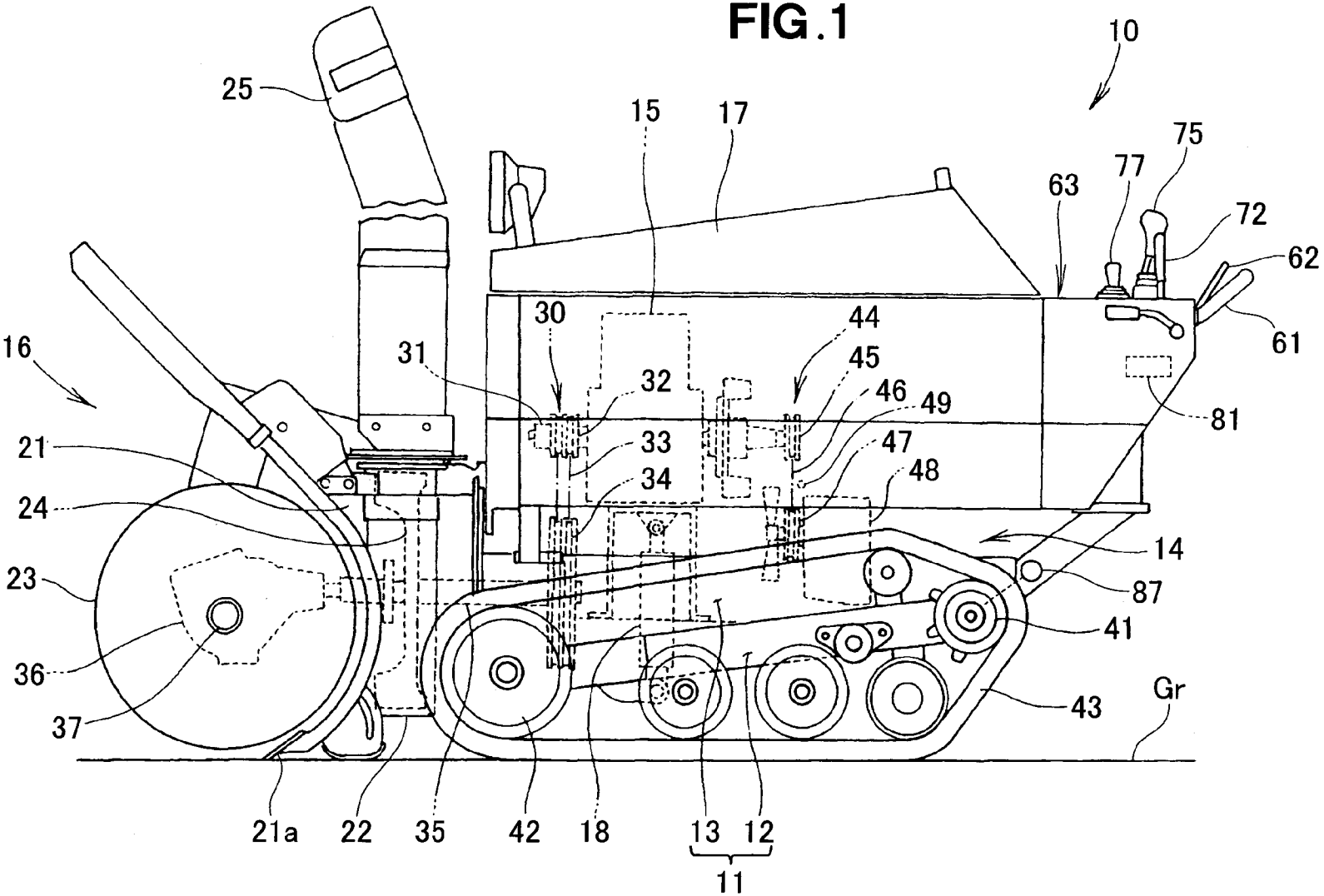
FIG. 1 is a side view of a snow plow according to the present invention.

As shown in FIG. 1, a snow plow 10 is a self-propelled work machine in which an auger 23 and a blower 24 for dispersing snow gathered by the auger 23 peripherally outward from a shooter 25 are driven by an engine 15, the snow plow 10 being self-propelled by means of travel device 14. The engine 15 is covered by an engine cover 17.

Specifically, a chassis 11 of the snow plow 10 comprises a travel frame 12 and a vehicle body frame 13. The travel frame 12 includes the travel device 14. The vehicle body frame 13 includes the engine 15 and a snow-plowing implement 16. The rear part of the vehicle body frame 13 is mounted to the travel frame 12 so as to be able to swing up and down. The front part of the vehicle body frame 13 is driven by a raising/lowering drive mechanism 18 so as to be raised and lowered (swung up and down).

Figure 2:
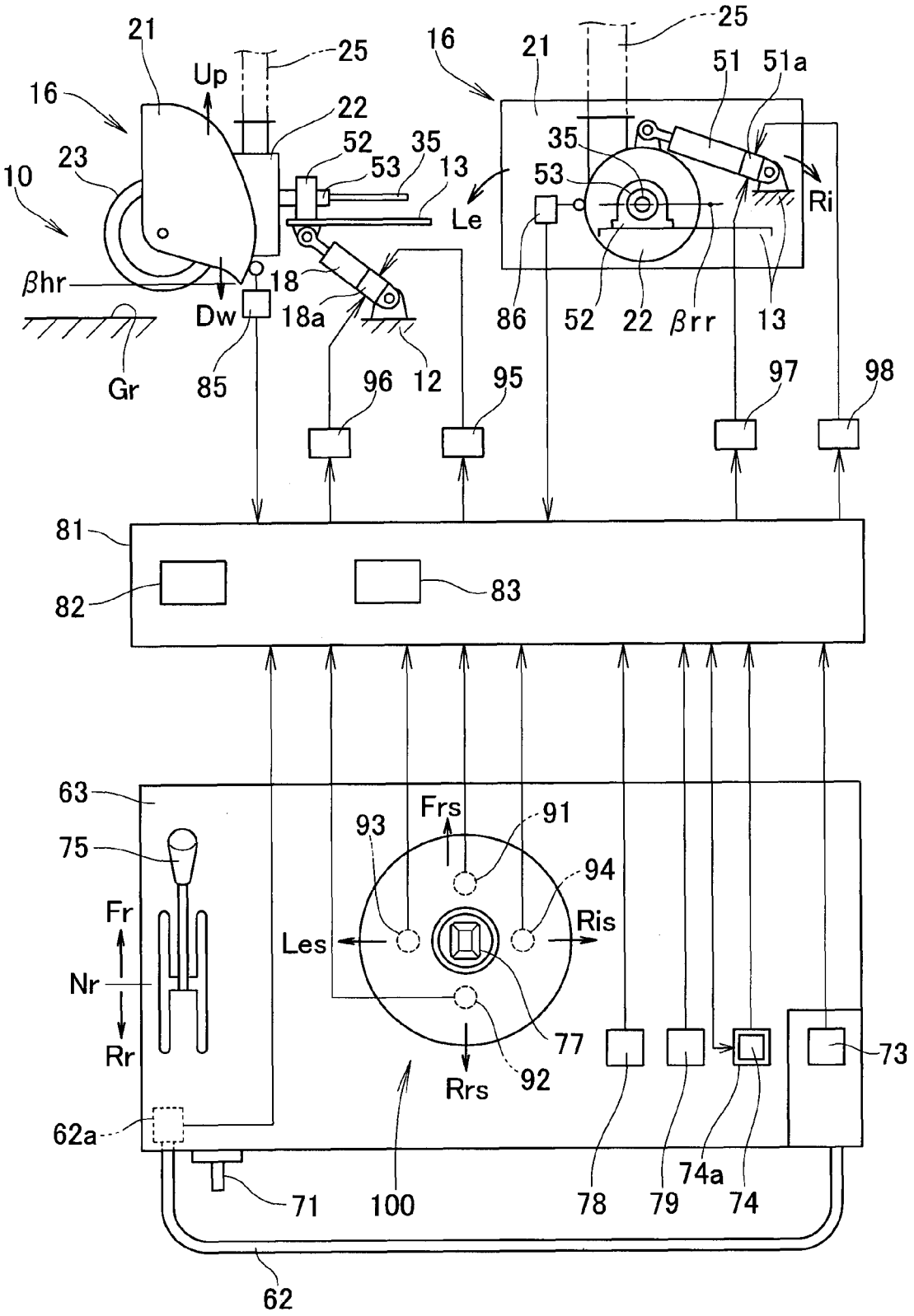
FIG. 2 is a schematic view of a relationship between an operation unit and a snow-plowing implement shown in FIG. 1.

As shown in FIG. 2, the raising/lowering drive mechanism 18 is an actuator in which a piston can extend from and withdraw into a cylinder. For example, the actuator is a type of electro-hydraulic cylinder in which a hydraulic pump (not shown) is driven by an electric motor 18*a*, whereby a piston is extended and retracted by the hydraulic pressure produced by the hydraulic pump. The electric motor 18*a* is a raising/lowering drive source incorporated integrally into a side part of the cylinder of the raising/lowering drive mechanism 18.

One end of the raising/lowering drive mechanism 18 is mounted to the travel frame 12 so as to be able to swing up and down. The other end of the raising/lowering drive mechanism 18 is mounted to the vehicle body frame 13 so as to be able to swing up and down. The vehicle body frame 13, an auger housing 21, and a blower case 22 can be raised and lowered (swung up and down) by the raising/lowering drive mechanism 18.

As shown in FIG. 1, the snow-plowing implement 16 comprises an auger housing 21, a blower case 22 integrated with the back surface of the auger housing 21, an auger 23 included in the auger housing 21, a blower 24 included in the blower case 22, and a shooter 25. The auger housing 21 includes a scraper 21*a* at the rear lower end.

The motive power of the engine 15 is transmitted to the snow-plowing implement 16 by a power transmission system 30. The power transmission system 30 comprises an auger clutch 31, a drive pulley 32, a belt 33, and a driven pulley 34. When the auger clutch 31 is activated, the motive power of the engine 15 is transmitted sequentially to the drive pulley 32, the belt 33, the driven pulley 34, a rotating shaft 35, a gear mechanism inside a gear case 36, an auger shaft 37, the auger 23, and the blower 24. The auger 23, which is caused to rotate by this power, scrapes up snow on the ground into the widthwise center of the auger, and feeds the snow to the blower 24. The blower 24 projects the snow through the shooter 25 through centrifugal force.

The auger clutch 31 is configured from a conventional electric clutch mechanism; e.g. an electromagnetic clutch or a motor-driven belt tensioning mechanism. When the auger clutch 31 is configured from an electromagnetic clutch, the auger clutch 31 is provided so as to be capable of coupling the drive pulley 32 and an output shaft of the engine 15. When configured from a conventional motor-driven belt tensioning mechanism, the auger clutch 31 comprises a tensioner capable of applying tension to the belt 33, and a motor for driving the tensioner.

The travel device 14 is configured from a crawler of which the basic elements are a drive wheel 41 (a transmission drive wheel 41), an idler wheel 42, and a crawler belt 43. The motive power of the engine 15 is transmitted to the travel device 14 by a travel power transmission system 44.

The travel power transmission system 44 comprises a drive pulley 45 mounted on the output shaft of the engine 15, a belt 46, a driven pulley 47, a hydraulic continuously variable transmission 48, and a belt tensioning mechanism 49. The hydraulic continuously variable transmission 48 is capable of forward and reverse rotation as well as continuously variable gear shifting. An output shaft of the hydraulic continuously variable transmission 48 is coupled to the drive wheel 41. The motive power of the engine 15 is transmitted sequentially to the drive pulley 45, the belt 46, the driven pulley 47, the hydraulic continuously variable transmission 48, the drive wheel 41, and the crawler belt 43, whereby the crawler belt 43 can be rotated and made to travel over a road.

The rotating direction and rotational speed of the drive wheel 41 are detected by a transmission rotation sensor 87. The transmission rotation sensor 87 either detects the rotating direction and rotational speed of one of the rotating shafts within the hydraulic continuously variable transmission 48, or directly detects the rotating direction and rotational speed of the drive wheel 41.

The belt tensioning mechanism 49 of the travel power transmission system 44, which has a conventional configuration, is configured from a tensioner (not shown) capable of applying tension to the belt 46. The tensioner is coupled to a travel preparatory lever 62 by a wire cable (not shown). Grasping the travel preparatory lever 62 allows the tensioner to be operated to apply tension to the belt 46. As a result, the motive power of the engine 15 can be transmitted from the drive pulley 45 to the driven pulley 47 by the belt 46.

The snow plow 10 is configured such that the auger housing 21 and the blower case 22 are rollably mounted to the vehicle body frame 13, and the auger housing 21 and the blower case 22 are rolled by a rolling drive mechanism 51 (see FIG. 2).

To give a more detailed description, as shown in FIG. 2, a rotating support part 53 is supported on the front end of the vehicle body frame 13 by a bearing 52 so as to be capable of rotating left and right. The rear end of the blower case 22 is secured to the rotating support part 53. Furthermore, the rotating support part 53 supports the rotating shaft 35, which extends longitudinally with respect to the blower case 22, the rotating shaft 35 being supported so as to be capable of rotating left and right. As a result, the auger housing 21 and the blower case 22 are mounted to the vehicle body frame 13 so as to be capable of rotating left and right (rolling) about the rotating shaft 35.

As described above, the travel frame 12 has a configuration including the mounted vehicle body frame 13. Therefore, the auger housing 21 and the blower case 22 are rollably mounted to the travel frame 12. As a result, the auger housing 21 is capable of rising, falling, and rolling relative to the travel frame 12.

The rolling drive mechanism 51 is an actuator in which a piston can extend from and withdraw into a cylinder. For example, the actuator is a type of electro-hydraulic cylinder in which a hydraulic pump (not shown) is driven by an electric motor 51*a*, and a piston is thereby extended and retracted by the hydraulic pressure produced by the hydraulic pump. The electric motor 51*a* is a rolling drive source incorporated integrally into a side of the cylinder of the cylinder of the rolling drive mechanism 51.

One end of the rolling drive mechanism 51 is mounted to the vehicle body frame 13 so as to be capable of swinging left and right. The other end of the rolling drive mechanism 51 is mounted to the back surface of the blower case 22 so as to be capable of swinging left and right. The auger housing 21 and the blower case 22 can be rolled by the rolling drive mechanism 51.

Figure 3:
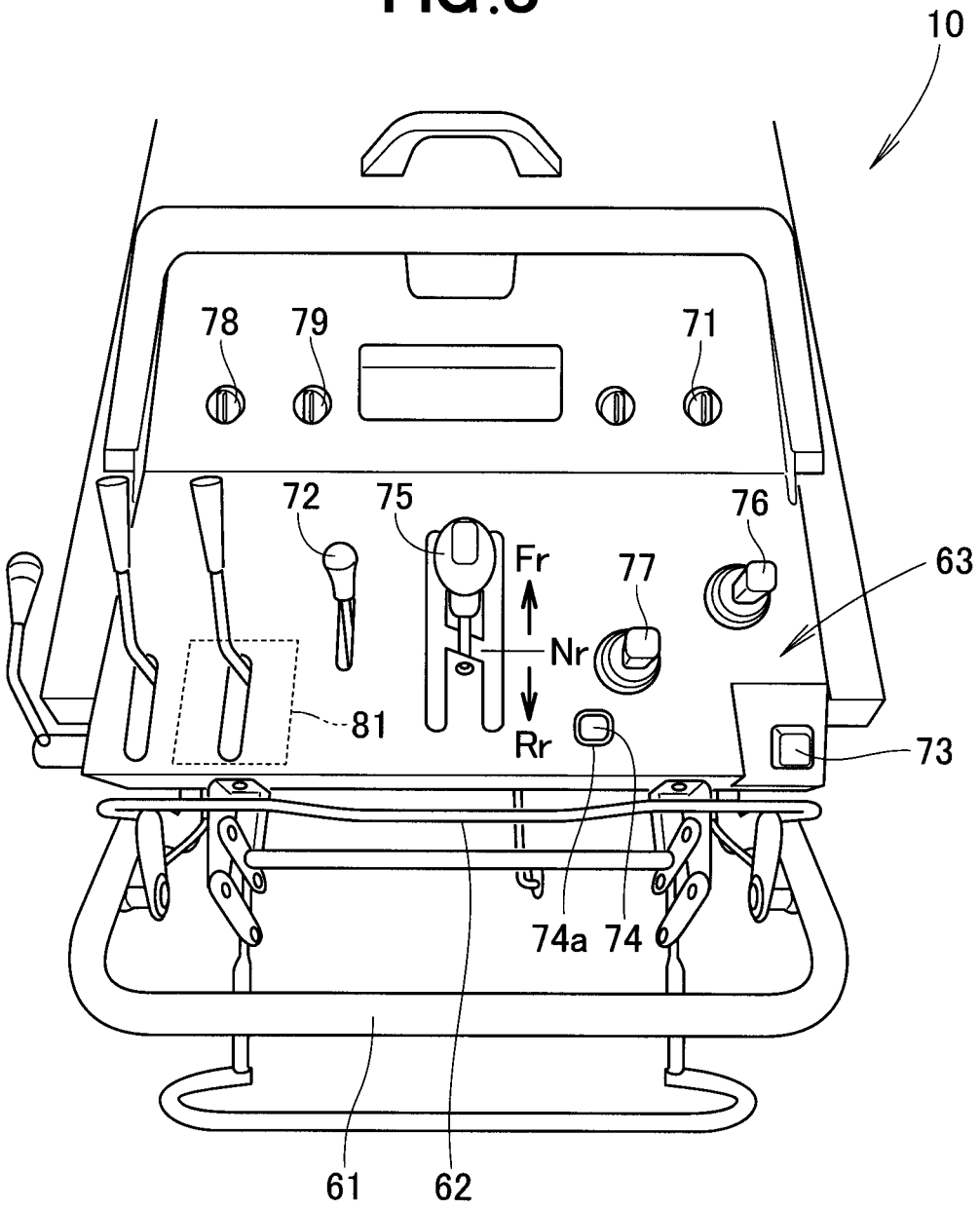
FIG. 3 is a perspective view as seen from the rear and above of the operation unit shown in FIG. 1.

As shown in FIGS. 1 and 3, an operating handle 61, the travel preparatory lever 62, and an operating unit 63 are provided to the back part of the vehicle body frame 13. The operating handle 61 is a handle that is positioned on the rear part of the operating unit 63 and is substantially U-shaped in plan view. A worker can operate the snow plow 10 by means of the operating handle 61 while walking behind the snow plow 10.

The travel preparatory lever 62 is an operating member that is positioned along the operating handle 61 on the rear part of the operating unit 63 and is substantially U-shaped in plan view, the lever being mounted to the vehicle body frame 13 so as to be capable of swinging up and down. The travel preparatory lever 62, known as a "dead man's lever," is normally in a free state due to the urging force of a return spring, and when this lever is gripped together with the operating handle 61 by a worker, a clutch lever switch 62*a* (see FIG. 2) can be turned on. When the clutch lever switch 62*a* is on, the auger clutch 31 (see FIG. 1) is turned on by turning on an auger switch 73.

Furthermore, the belt tensioning mechanism 49 can be operated via the wire cable by grasping the travel preparatory lever 62 and the operating handle 61 together, to apply tension to the belt 46. As a result, the motive power of the engine 15 can be transmitted from the drive pulley 45 to the driven pulley 47 by the belt 46.

As shown in FIGS. 2 and 3, the operating unit 63 includes a main switch 71, a throttle lever 72, the auger switch 73, a reset switch 74, a reset display light 74*a*, a directional speed lever 75, a shooter operation lever 76, an auger housing lever 77, an auto height switch 78, and an auger assist switch 79.

The main switch 71 is a manual switch capable of starting up the engine 15 (see FIG. 1) by being turned on and stopping the engine 15 by being turned off, and is, for example, a rotary switch. The throttle lever 72 is an operating member for controlling the speed of the engine 15.

The auger switch 73 (also referred to as the "clutch operation switch 73") is a manual switch for shifting the auger clutch 31 (see FIG. 1) between on and off, and comprises, e.g., a push-button switch. When the clutch lever switch 62*a* is turned on by grasping the travel preparatory lever 62, the auger clutch 31 is turned on by operating the auger switch 73, and the auger 23 and the blower 24 can be rotated by the motive power of the engine 15 shown in FIG. 1.

When the auger clutch 31 is configured from a motor-driven belt tensioning mechanism, the tensioner driven by the forward rotation of the motor applies tension to the belt 33. The auger clutch 31 can be turned off either by releasing the travel preparatory lever 62 or by operating the auger switch 73. When the auger clutch 31 is configured from a motor-driven belt tensioning mechanism, reverse rotation of the motor causes the tensioner to release the tension on the belt 33.

The reset switch 74 (also referred to as the "original auger position auto-return switch 74") is a manual switch for returning the orientation (position) of the auger housing 21 to the original point which has been set in advance. A push button switch, for example, is used as the reset switch 74. The reset switch 74 is an "automatic return switch," which is turned on by the push button being pushed by a hand, and turned off by the hand being withdrawn and the push button being automatically returned by a return spring to the position prior to being pushed. The reset display light 74*a* illuminates in conjunction with the reset switch 74 turning on, and extinguishes when the auger assist switch 79 turns off, for example.

The cause of this is that when the auger housing 21 is disposed horizontally as shown in FIG. 1, for example, a bottom end of a scraper 21*a* included in the auger housing 21 is positioned to be in contact with a horizontal, flat surface Gr (the traveled road surface Gr) in both the height direction and the rolling direction.

As shown in FIGS. 2 and 3, the reset display light 74*a* illuminates in conjunction with the turning on of the reset switch 74, and extinguishes when, for example, the auger assist switch 79 turns off.

The directional speed lever 75 (also referred to as the "forward-backward travel speed adjustment lever 75") is an operating member for adjusting the traveling state of the snow plow 10 by being reciprocatingly operated by hand. The directional speed lever 75 can be swingingly operated forward and backward from a stop position Nr where the lever stands upright in the middle, forward to a forward Fr side and backward to a reverse Rr side. The directional speed lever 75 is coupled to a gear shift lever of the hydraulic continuously variable transmission 48 (see FIG. 1) by a coupling mechanism such as a link mechanism or a wire cable. The rotating direction and rotational speed of the output shaft of the hydraulic continuously variable transmission 48 are varied by adjusting the hydraulic continuously variable transmission 48 by means of the directional speed lever 75.

Thus, the directional speed lever 75 is an operating member for adjusting the traveling state of the snow plow 10, i.e. the forward speed or the reverse speed. In other words, the directional speed lever 75 is an operating member for operating the traveling speed of the travel device 14 (see FIG. 1).

When the directional speed lever 75 is positioned in the stop position Nr, the hydraulic continuously variable transmission 48 is in a neutral state and output to the travel device 14 remains at zero. The travel device 14 is therefore stopped. The transmission rotation sensor 87 (see FIG. 1) detects that the travel device 14 has stopped because the hydraulic continuously variable transmission 48 is in a neutral state.

When the directional speed lever 75 is swung from the stop position Nr to the forward Fr side, the hydraulic continuously variable transmission 48 transmits to the travel device 14 forward-directional output at a speed according to the swing angle of the directional speed lever 75. As a result, the travel device 14 moves forward. The transmission rotation sensor 87 detects that the travel device 14 is rotating in the forward direction.

When the directional speed lever 75 is swung from the stop position Nr to the reverse Rr side, the hydraulic continuously variable transmission 48 transmits to the travel device 14 reverse-directional output at a speed according to the swing angle of the directional speed lever 75. As a result, the travel device 14 moves in reverse. The transmission rotation sensor 87 detects that the travel device 14 is rotating in the reverse direction.

The shooter operation lever 76 is an operating member for varying the left-right orientation of the shooter 25 (see FIG. 1). The up-down direction of the top part of the shooter 25 can be adjusted by the shooter operation lever 76 to adjust the blown direction of the scraped up snow.

The auger housing lever 77 (an auger housing orientation operation lever 77) is an operating member for varying the orientation of the auger housing 21. In other words, the auger housing lever 77 is an operating member for operating the raising/lowering drive mechanism 18 and the rolling drive mechanism 51 for the purpose of raising, lowering, and rolling the auger housing 21 in line with the snow surface during snow blowing work with the auger 23.

The auto height switch 78 is a manual switch shifted between on and off in order for a control unit 81 to execute control of an auto height-up mode and an auto height-down mode, and this switch comprises, e.g., a rotary switch.

Figure 7A:
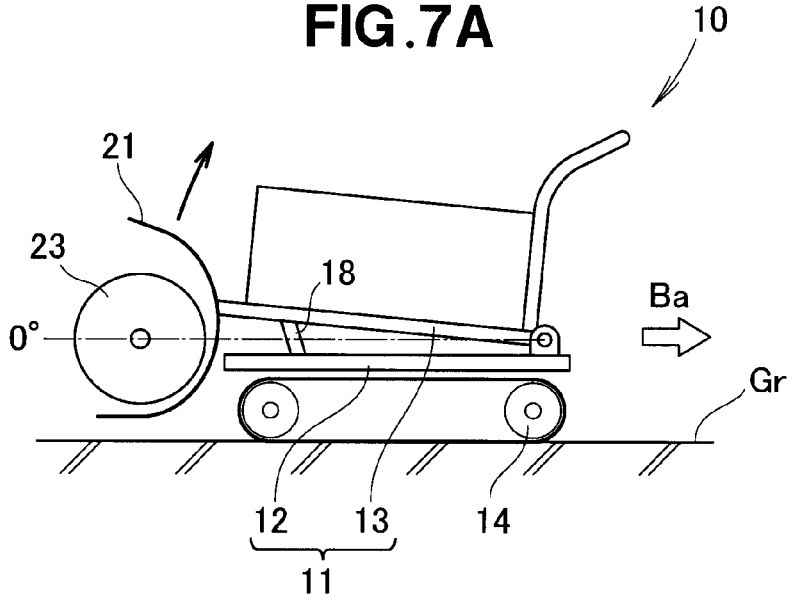
FIGS. 7A and 7B are views illustrating a relationship between the behavior of the travel device shown in FIG. 1 and the height action of the auger housing.
Figure 7B:
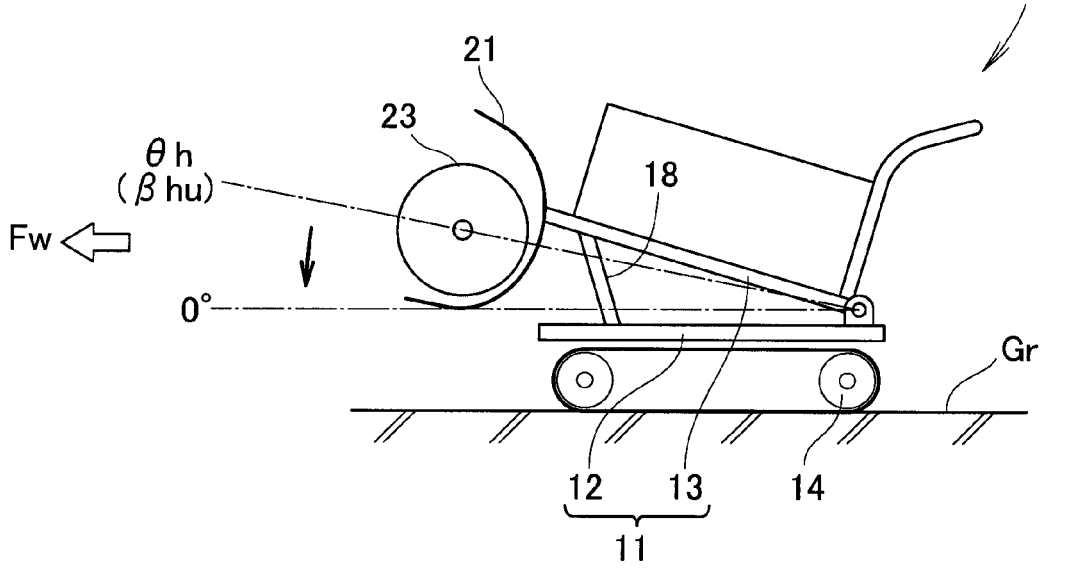

As shown in FIGS. 7A and 7B, the auto height-up mode is a control mode for controlling the raising/lowering drive mechanism 18 so that the auger housing 21 is automatically raised to a predetermined upper limit angle βhu when the travel device 14 is in reverse. If the auto height-up mode is enabled, the auger housing 21 can be prevented from catching on the snow surface when the travel device 14 is in reverse.

The auto height-down mode is a control mode for controlling the raising/lowering drive mechanism 18 so that the auger housing 21 is automatically returned to the same pre-reversing height; i.e. to the original height, when the auger 23 is rotating and the travel device 14 again moves forward.

In the auto height-up mode and the auto height-down mode, an angle of inclination βhr detected by a height position sensor 85 shown in FIG. 2 is employed as the current height of the auger housing 21.

The auger assist switch 79 shown in FIG. 3 is a manual switch shifted between on and off in order for the control unit 81 to execute control of an assist mode, the switch comprising, e.g., a rotary switch. In the assist mode, an angle of inclination θh based on an acceleration αh detected by an acceleration sensor 83 shown in FIG. 2 is employed as the current height of the auger housing 21.

The assist mode is a control mode for controlling the raising/lowering drive mechanism 18 when control of the auto height-down mode is executed so that, as shown in FIGS. 7A and 7B, if the current angle of inclination θh is far from the height θmin of the auger housing 21 immediately before the reversing, the mechanism is lowered at a high speed, and if the angle of inclination θh is near the height θmin, the mechanism is lowered at a low speed.

Next, the control system of the snow plow 10 is described.

As shown in FIG. 2, the control system of the snow plow 10 is focused around the control unit 81. The control unit 81 houses a memory 82, and the control unit is configured to appropriately read and control various pieces of information stored in the memory 82.

Furthermore, the control unit 81 houses the acceleration sensor 83 for detecting the acceleration produced in the auger housing 21. The acceleration sensor 83 is integrated on a substrate together with other electronic circuitry and the like of the control unit 81, for example. As described above, the auger housing 21 and the operating unit 63 are provided to the vehicle body frame 13. The control unit 81 is provided inside the operating unit 63. Therefore, the orientation of the acceleration sensor 83 can be varied together with the auger housing 21. In other words, the acceleration sensor 83 has substantially the same configuration as when it is provided directly to the auger housing 21, and the sensor is capable of detecting acceleration produced in the auger housing 21.

The acceleration sensor 83 comprises a triaxial acceleration sensor capable of detecting acceleration in the directions of three axes: an x-axis, a y-axis, and a z-axis. The triaxial acceleration sensor may be a common "semiconductor acceleration" sensor. Types of semiconductor acceleration sensors include piezo resiorientation sensors, static capacitance sensors, and heat-detecting sensors, for example.

Such triaxial acceleration sensors are capable of detecting acceleration in the directions of three axes produced in the auger housing 21. Acceleration in the x-axis direction, for example, is vertical linear acceleration; i.e. acceleration in the direction of gravity (gravitational acceleration) produced in the auger housing 21. Acceleration in the y-axis direction is acceleration in the left-right horizontal direction, produced in the auger housing 21. Acceleration in the z-axis direction is acceleration in the forward-backward horizontal direction, produced in the auger housing 21.

The acceleration produced in the auger housing 21 is detected by the acceleration sensor 83, and the angle of inclination of the auger housing 21 relative to the direction of gravity can be determined based on the detection value. Therefore, in the present invention, the acceleration sensor 83 can be considered to be a horizontal detection unit for detecting the horizontal state of the auger housing relative to the direction of gravity. The acceleration sensor 83 is also referred to below as a "horizontal detection unit 83" where appropriate.

Next, the relationship between the snow-plowing implement 16 and the auger housing lever 77 is described in detail based on FIG. 2.

A housing orientation operating unit 100 is configured from the auger housing lever 77 and four switches 91 to 94 for operating the orientation of the auger housing. Electric power can be supplied to the electric motors 18*a*, 51*a* by swinging the auger housing lever 77 and turning on switch elements 95 to 98 individually. The switch elements 95 to 98 are configured from field effect transistors (FET), for example.

When the auger housing lever 77 is swung to the front side Frs, a lowering switch 91 turns on. The control unit 81, having received an on signal, supplies electric power to the electric motor 18*a* to cause forward rotation by turning on a lowering switch element 95. The raising/lowering drive mechanism 18 thereby lowers the auger housing 21 and the blower case 22 (displaces them in the direction of the arrow Dw).

When the auger housing lever 77 is swung to the rear side Rrs, a raising switch 92 turns on. The control unit 81, having received an on signal, supplies electric power to the electric motor 18*a* to cause backward rotation by turning on a raising switch element 96. The raising/lowering drive mechanism 18 thereby raises the auger housing 21 and the blower case 22 (displaces them in the direction of the arrow Up).

When the auger housing lever 77 is swung to the left side Les, a left-rolling switch 93 turns on. The control unit 81, having received an on signal, supplies electric power to the electric motor 51*a* to cause forward rotation by turning on a left-rolling switch element 97. The rolling drive mechanism 51 thereby tilts (rolls) the auger housing 21 and the blower case 22 to the left Le.

When the auger housing lever 77 is swung to the right side Ris, a right-rolling switch 94 turns on. The control unit 81, having received an on signal, supplies electric power to the electric motor 51*a* to cause backward rotation by turning on a right-rolling switch element 98. The rolling drive mechanism 51 thereby tilts (rolls) the auger housing 21 and the blower case 22 to the right Ri.

Thus, swinging the auger housing lever 77 forward and backward causes the electric motor 18*a* to rotate forward and backward and the piston of the raising/lowering drive mechanism 18 to extend and retract. As a result, the auger housing 21 and the blower case 22 rise and fall. The vertical position of the auger housing 21 is detected by the height position sensor 85, and a detection signal produced thereby is sent to the control unit 81.

Similarly, swinging the auger housing lever 77 to the left and right causes the electric motor 51*a* to rotate forward and backward and the piston of the rolling drive mechanism 51 to extend and retract. As a result, the auger housing 21 and the blower case 22 roll to the left and right. The rolling position of the auger housing 21 is detected by a rolling position sensor 86, and a detection signal thereof is sent to the control unit 81.

The height position sensor 85 (first housing inclination angle detection unit 85), which detects the relative angle of inclination βhr of the auger housing 21 in the vertical direction (the height direction) in relation to the travel frame 12, is configured from a waterproof rotary potentiometer, for example. The height position sensor 85 is mounted on the vehicle body frame 13.

The rolling position sensor 86 (second housing inclination angle detection unit 86), which detects the relative angle of inclination θrr of the auger housing 21 in the left-right direction in relation to the vehicle body frame 13, is configured from a waterproof rotary potentiometer, for example. The rolling position sensor 86 is mounted on the front end of the vehicle body frame 13. Accordingly, the vehicle body frame 13 does not become relatively inclined in the left-right direction in relation to the travel frame 12. Therefore, the rolling position sensor 86 detects the relative angle of inclination of the auger housing 21 in the left-right direction in relation to the travel frame 12.

As described above, the height position sensor 85 is a relative angle detection unit for detecting the relative angle of inclination θhr of the auger housing 21 in the vertical direction (the height direction) in relation to the travel frame 12. The height position sensor 85 is referred to below as the "relative angle detection unit 85" where appropriate. The rolling position sensor 86 is also a relative angle detection unit for detecting the relative angle of inclination θrr of the auger housing 21 in the left-right direction in relation to the vehicle body frame 13. The rolling position sensor 86 is referred to below as the "relative angle detection unit 86" where appropriate.

Figure 4:
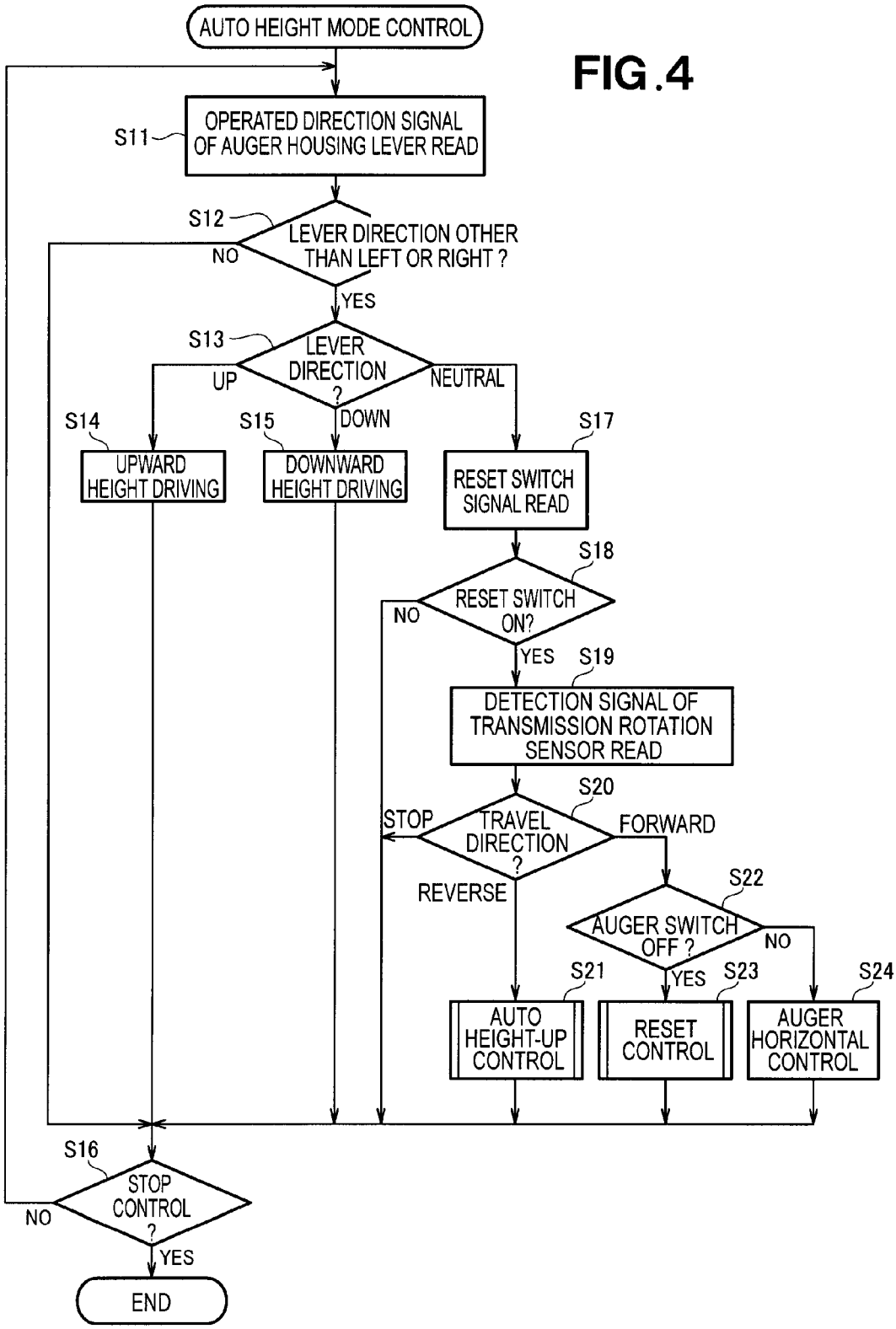
FIG. 4 is a control flowchart of the control unit shown in FIG. 2.
Figure 5:
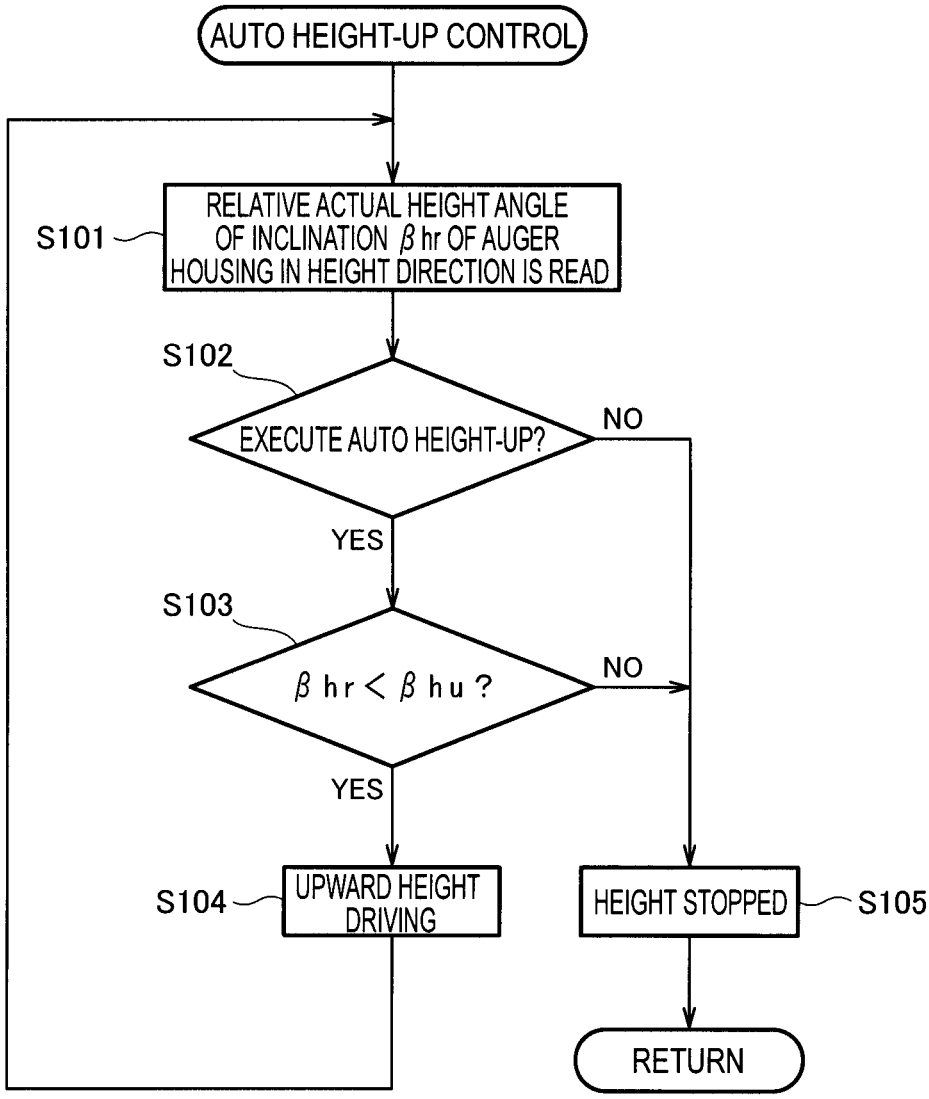
FIG. 5 is a specific control flowchart of the auto height-up control shown in FIG. 4.
Figure 6:
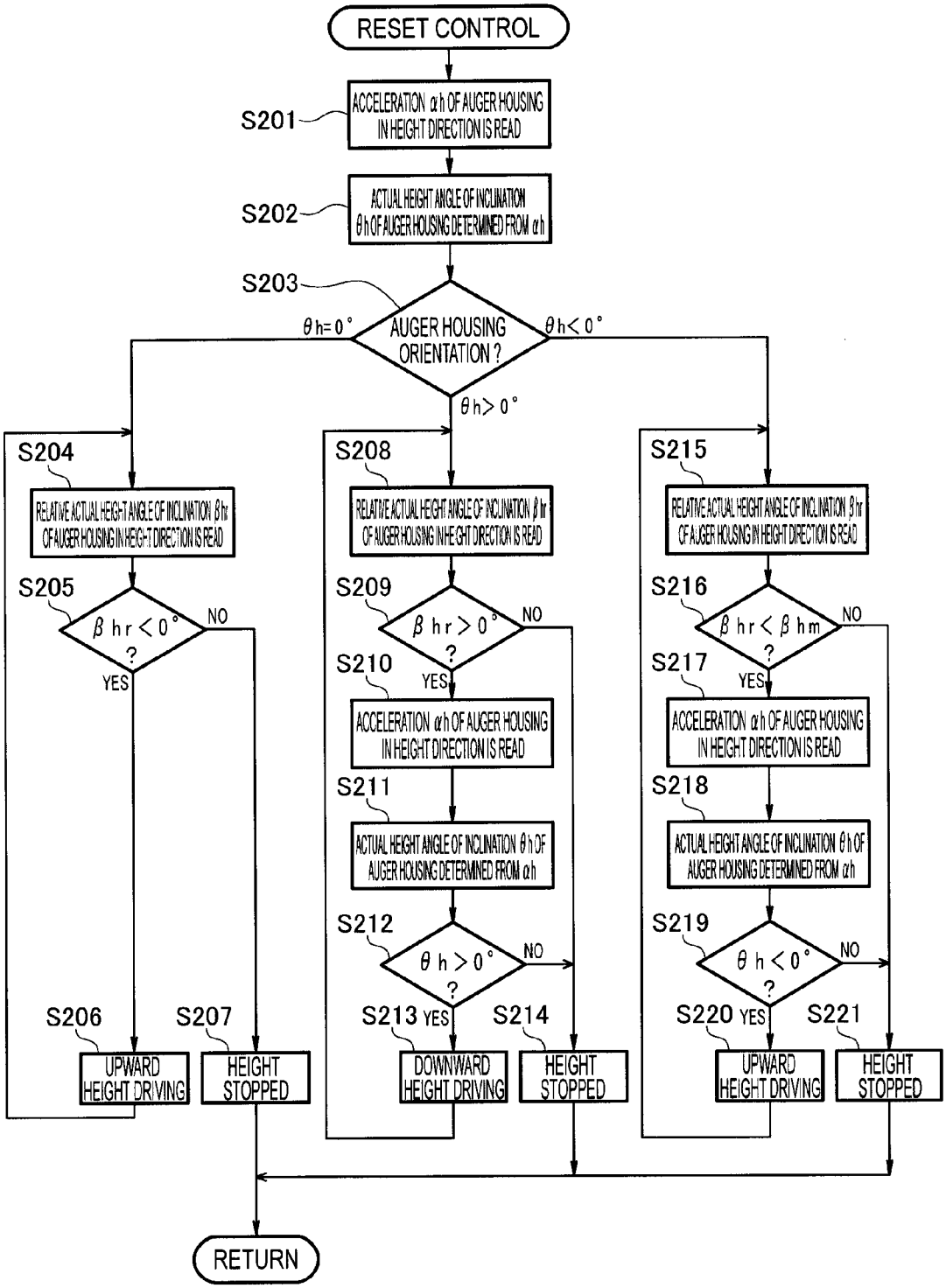
FIG. 6 is a specific control flowchart of the reset control shown in FIG. 4.

Next is a description, based on FIGS. 4 to 6, of the control flow when the control unit 81 (see FIG. 2) is configured from a microcomputer.

In this control flow, control is started when the following five conditions are all satisfied, for example. The first condition is that the main switch 71 be on. The second condition is that the clutch lever switch 62*a* be on (that the travel preparatory lever 62 be gripped). The third condition is that the auger clutch 31 be on (that the auger 23 be rotating). The fourth condition is that the auto height switch 78 be on. The fifth condition is that the auger assist switch 79 be on.

In the control flowchart shown in FIGS. 4 to 6, the only steps of controlling the snow plow 10 that will be described are those pertaining to the auto height of the auger housing 21 and assist mode control, steps pertaining to other controls being omitted. The description below refers to FIGS. 2 and 3.

FIG. 4 is a control flowchart of the control unit 81 relating to the present invention.

When the control unit 81 begins to perform a control, first, in step S11, the control unit reads switch signals of four switches 91 to 94 of the housing orientation operation unit 100 shown in FIG. 2. The direction in which the auger housing lever 77 is operated is perceived by these switch signals.

Next, an assessment is made as to whether or not the direction in which the auger housing lever 77 is operated is a direction other than left or right (step S12).

When the direction in which the auger housing lever 77 is operated is assessed to be the left side Les or the right side Ris in step S12, the auger housing 21 and the blower case 22 are rolled to the left Le or the right Ri, after which the flow advances to step S16. In step S16, the control unit 81 assesses whether or not to stop this control flow.

When the direction in which the auger housing lever 77 is operated is assessed to be a direction other than left or right in step S12, an assessment is made as to whether the direction in which the auger housing lever 77 is operated is up, down, or neutral (step S13).

When the direction in which the auger housing lever 77 is operated is assessed to be the top side Fras in step S13, the flow advances to step S14. In step S14, the auger housing 21 and the blower case 22 are tilted upward Up (driven upward in height) by the raising/lowering drive mechanism 18.

When the direction in which the auger housing lever 77 is operated is assessed to be the down side Rrs in step S13, the flow advances to step S15. In step S15, the auger housing 21 and the blower case 22 are tilted downward Dw (driven downward in height) by the raising/lowering drive mechanism 18.

After the processes of step S14 or step S15 is complete, the control unit 81 assesses whether or not to stop the control flow (step S16). In step S16, when "all" of the following four conditions are satisfied, the control unit assesses that control is to be continued and the flow returns to step S11.

The first condition is that the main switch 71 be on. The second condition is that the clutch lever switch 62*a* be on (that the travel preparatory lever 62 be gripped). The third condition is that the auger switch 73 be on. The fourth condition is that the auto height switch 78 be on. When even one of these four conditions is not satisfied, the control unit assesses that control is to be stopped and the series of control is to be ended.

When the assessment in step 13 is that the direction in which the auger housing lever 77 is operated is neutral, the flow advances to step S17. In step S17, a switch signal of the reset switch 74 is read.

Next, in step S18, an assessment is made as to whether or not the reset switch 74 is on. When the switch is assessed to be off in step S18, the flow advances to step S16. When the switch is assessed to be on in step S18, the flow advances to step S19. In step S19, a detection signal of the transmission rotation sensor 87 is read.

Next, in step S20, the direction in which the directional speed lever 75 is operated is assessed based on the detection signal of the transmission rotation sensor 87. When the direction in which the directional speed lever 75 is operated is the neutral position, the control unit assesses that stop control is to be performed and the flow advances to step S16.

When the direction in which the directional speed lever 75 is operated is the reverse direction, the control unit assesses that reverse travel control is to be performed, the flow advances to step S21 and auto height-up control is executed, after which the flow advances to step S16. The specific control flow for executing the auto height-up control process of step S21 is described based on FIG. 5.

When the direction in which the directional speed lever 75 is operated is the forward direction, the control unit assesses that forward travel control is to be performed and the flow advances to step S22. In step S22, the control unit reads a switch signal of the auger switch 73 and assesses whether or not the auger switch 73 is off.

When the assessment is off in step S22, the flow advances to step S23 and reset control is executed, after which the flow advances to step S16. The specific control flow for executing the reset control process of step S23 is described based on FIG. 6.

When the assessment in step S22 is that the auger switch 73 is on, the flow advances to step S24. In step S24, horizontal control of the auger housing 21 is executed according to the height angle of inclination θh determined from the acceleration αh, after which the flow advances to step S16.

The prerequisite condition for executing step S24 is that "all" of the following three conditions be satisfied. The first condition is that the travel direction be the forward direction (forward in step S20). The second condition is that the auger switch 73 be on (NO in step S22) as described above. The third condition is that the auger assist switch 79 be on assist mode).

The specific control contents of step S24 are as follows.

First, the acceleration αh of the auger housing 21 in the height direction is read. The detection value detected by the acceleration sensor 83 is preferably read for the acceleration αh in the height direction.

Next, the actual angle of inclination θh of the auger housing 21 in the height direction is determined from the acceleration αh. The actual angle of inclination θh is the actual height angle of inclination of the auger housing 21 relative to the direction of gravity, i.e. the actual height angle of inclination of the auger housing 21 relative to a horizontal ground surface Gr (road surface Gr).

Lastly, the orientation of the auger housing 21 relative to the direction of gravity, i.e. the horizontal state is assessed based on the actual height angle of inclination θh, and the raising/lowering drive mechanism 18 is controlled so that the auger housing 21 becomes horizontal.

Next, the specific control flow for executing the auto height-up control process is described. FIG. 5 is a subroutine whereby the control unit 81 executes the "auto height-up control" of step S21 shown in FIG. 4 described above.

In the auto height-up control, height direction control of the auger housing 21 is executed according to the angle of inclination βhr detected by the height position sensor 85. First, the control unit 81 reads the relative angle of inclination βhr of the auger housing 21 in the height direction (the actual height inclination angle βhr at the current point in time) in relation to the travel frame 12 (step S101). To read the angle of inclination βhr, a detection signal of the height position sensor 85 is preferably read.

Next, in step S102, an assessment is made of whether or not to execute auto height-up control. Specifically, an assessment to execute auto height-up control is made when the following three conditions are all satisfied. The first condition is that the main switch 71 be on. The second condition is that the clutch lever switch 62*a* be on (that the travel preparatory lever 62 be gripped). The third condition is that the auto height switch 78 be on.

When the assessment is to not execute this control in step S102, the electric motor 18*a* is stopped and the rising of the auger housing 21 is stopped (step S105) by turning off the raising switch element 96, after which the subroutine is ended and the flow advances to step S21 shown in FIG. 4 described above. When the assessment is to execute the control in step S102, the flow advances to step S103.

In step S103, an assessment is made as to whether or not the actual height angle of inclination βhr at the current point in time is less than the reversing height upper limit angle βhu. The reversing height upper limit angle βhu (the upper limit value βhu of the height angle of inclination) is set to a predetermined upper limit angle set in advance, such that the bottom end of the auger housing 21 does not drag over the ground surface Gr when the travel device 14 is reversing.

When the assessment in step S103 is that βhr is less than βhu, the raising switch element 96 is turned on, causing electric power to be supplied to the electric motor 18*a* and backward rotation to be performed (step S104), after which the flow returns to step S101. The raising/lowering drive mechanism 18 thereby raises the auger housing 21 and the blower case 22. This upward Up driving is continued until it is assessed in step S103 that the actual height angle of inclination βhr has risen to the reversing height upper limit angle βhu.

When it is assessed in step S103 that the actual height angle of inclination βhr at the current point in time has risen to the reversing height upper limit angle βhu, the raising switch element 96 is turned off, causing the electric motor 18*a* to stop and the rising of the auger housing 21 to stop (step S105), after which the subroutine is ended and the flow advances to step S21 shown in FIG. 4 described above.

Next, the specific control flow for executing the reset control process is described. FIG. 6 is a subroutine whereby the control unit 81 executes the "reset control" of step S23 shown in FIG. 4 described above.

In the reset control, control of the height direction of the auger housing 21 is executed according to the angle of inclination βhr detected by the height position sensor 85 and the actual height angle of inclination θh determined from the acceleration αh.

The control unit 81 first reads the acceleration αh of the auger housing 21 in the height direction in step S201. For the height-direction acceleration αh (actual acceleration αh), a detection value detected by the acceleration sensor 83 is preferably read.

Next, the actual height angle of inclination θh of the auger housing 21 in the height direction is determined from the acceleration αh (step S202). The actual height angle of inclination θh is the actual height angle of inclination of the auger housing 21 in relation to the direction of gravity; i.e., the actual height angle of inclination of the auger housing 21 in relation to a horizontal ground surface Gr (road surface Gr). The method of determining the angle of inclination θh in the height direction (referred to below as the actual height angle of inclination θh) on the basis of the acceleration αh is preferably a method that does so; e.g., using common computation formulae or a map. When a map is employed, the relationship of the actual height angle of inclination θh to the acceleration αh is set in advance and stored in the memory 82.

In step S202, it is preferable to have a filter function for slowly changing the value of the acceleration αh when the snow plow 10 is accelerating, decelerating, or turning. Furthermore, in step S202, the value of the actual height angle of inclination θh is preferably corrected using a reference value corrected (zero point corrected) for individual snow plows 10 prior to shipping from a production factory. This reference value is stored in the memory 82.

Next, in step S203, the orientation of the auger housing 21 relative to the direction of gravity, i.e. the horizontal state, is assessed based on the actual height angle of inclination θh.

In step S203, when the value of the actual height angle of inclination θh is assessed to be 0° (θh=0°), or in other words when the auger housing is assessed to be horizontal, the flow advances to step S204 and up-height direction control is executed on the auger housing 21.

First, in step S204, the relative angle of inclination βhr of the auger housing 21 in the height direction (the actual height inclination angle βhr at the current point in time) in relation to the travel frame 12 is read. To read the angle of inclination βhr, a detection signal of the height position sensor 85 is preferably read.

Next, in step S205, an assessment is made of whether or not the actual height angle of inclination βhr (the relative angle of inclination βhr) at the current point in time is less than 0°. When the actual height angle of inclination βhr is assessed to be less than 0° (βhr<0°), the raising switch element 96 is turned on, causing electric power to be supplied to the electric motor 18*a* and backward rotation to be performed (step S2046, after which the flow returns to step S204. The raising/lowering drive mechanism 18 thereby raises the auger housing 21 and the blower case 22. This upward Up driving is continued until it is assessed in step S205 that the actual height angle of inclination βhr has risen to 0°.

When it is assessed in step S205 that the actual height angle of inclination βhr at the current point in time has risen to 0° (βhr>0° or βhr=0°), the raising switch element 96 is turned off, causing the electric motor 18*a* to stop and the rising of the auger housing 21 to stop (step S207), after which the subroutine is ended and the flow advances to step S23 shown in FIG. 4 described above.

When it is assessed in step S203 that the actual height angle of inclination θh is greater than 0° (θh>0°), or in other words that the auger housing 21 is in a front-raised state, the flow advances to step S208 and down-height direction control is executed on the auger housing 21. For example, when the travel device 14 is traveling over an upward-inclined road surface, the auger housing 21 is in a front-raised state, and the auger housing 21 is therefore lowered so as to be horizontal.

First, in step S208, the relative angle of inclination βhr of the auger housing 21 in the height direction (the actual height inclination angle βhr at the current point in time) in relation to the travel frame 12 is read. To read the angle of inclination βhr, a detection signal of the height position sensor 85 is preferably read.

Next, in step S209, an assessment is made of whether or not the actual height angle of inclination βhr (the relative angle of inclination βhr) at the current point in time is greater than 0°. When the relative angle of inclination βhr is assessed to be greater than 0° (βhr>0°), the flow advances to step S210.

In step S210, the acceleration αh of the auger housing 21 in the height direction is again read. To read the acceleration αh in the height direction, a detection value detected by the acceleration sensor 83 is preferably read.

Next, in step S211, the actual angle of inclination θh of the auger housing 21 in the height direction (the actual height angle of inclination θh) is determined from the acceleration αh. The method for determining the actual height angle of inclination θh on the basis of the actual acceleration αh is the same as in step S202 described above. The filter function and the zero point correction are also the same as in step S202 described above.

Next, in step S212, when the actual height angle of inclination θh is assessed to be greater than 0° (θh>0°), or in other words when the auger housing 21 is assessed to be in a front-raised state, the flow advances to step S213.

Thus, steps S208 to S213 are repeated while the relative angle of inclination βhr is assessed in step S209 to not be 0° (βhr>0°) and the auger housing 21 is assessed in step S212 to not be horizontal (θh>0°). In other words, the control unit 81 controls the raising/lowering drive mechanism 18 so as to lower the auger housing 21.

More specifically, in step S213, the lowering switch element 95 is turned on, supplying electric power to the electric motor 18*a* to cause forward rotation, after which the flow returns to step S208. The raising/lowering drive mechanism 18 thereby lowers the auger housing 21 and the blower case 22.

In other words, when it is assessed in step S209 that the relative angle of inclination βhr has lowered to 0° (βhr<0° or βhr=0°), or when it is assessed in step S212 that the auger housing 21 is horizontal (θh<0° or θh=0°), the lowering switch element 95 is turned off in step S214, thereby stopping the electric motor 18*a* and stopping the lowering of the auger housing 21, after which the subroutine ends and the flow returns to step S23 shown in FIG. 4 described above.

As is made clear from the above description, the control unit 81 controls the raising/lowering drive mechanism 18 so that the auger housing 21 becomes horizontal (step S213), and when either of the following first and second conditions is assessed to be satisfied, the control unit executes control for stopping the raising/lowering drive mechanism 18 (step S214). The first condition is that the relative angle of inclination βhr be 0° (an assessment of NO in step S209). The second condition is that the auger housing 21 be horizontal (an assessment of NO in step S212).

In step S203 described above, when the actual height angle of inclination θh is assessed to be less than 0° (θh<0°), or in other words when the auger housing 21 is assessed to be in a front-lowered state, the flow advances to step 215 and up-height direction control is executed on the auger housing 21. For example, when the travel device 14 is traveling over a downward-inclined road surface, the auger housing 21 is in a front-lowered state and the auger housing 21 is therefore raised so as to be horizontal.

First, in step S215, the relative angle of inclination βhr of the auger housing 21 in the height direction relative to the travel frame 12 (the actual height angle of inclination θhr at the current point in time) is read. To read the angle of inclination θhr, a detection signal of the height position sensor 85 is preferably read.

Next, in step S216, an assessment is made as to whether or not the actual height angle of inclination βhr (the relative angle) at the current point in time is less than an operative upper limit value βhm. The operative upper limit value βhm is set to the maximum angle at which the auger housing 21 can be raised relative to the travel frame 12. When the assessment in step S216 is that the relative angle of inclination βhr is less than the operative upper limit value βhm (βhr<βhm), the flow advances to step S217.

In step S217, the acceleration αh of the auger housing 21 in the height direction is again read. To read the acceleration αh in the height direction, a detection value detected by the acceleration sensor 83 is preferably read.

Next, in step S218, the actual angle of inclination θh of the auger housing 21 in the height direction (the actual height angle of inclination θh) is determined from the acceleration αh. The method for determining the actual height angle of inclination θh on the basis of the actual acceleration αh is the same as in step S202 described above. The filter function and the zero point correction are also the same as in step S202 described above.

Next, in step S219, when the actual height angle of inclination θh is assessed to be less than 0° (θh<0°), or in other words when the auger housing 21 is assessed to be in a front-lowered state, the flow advances to step S220.

Thus, steps S215 to S220 are repeated while the relative angle of inclination βhr is assessed in step S216 to be less than the operative upper limit value βhm (βhr<βhm) and the auger housing 21 is assessed in step S219 to not be horizontal (&h<0°). In other words, the raising/lowering drive mechanism 18 is controlled so as to raise the auger housing 21.

More specifically, in step S220, the raising switch element 96 is turned on, supplying electric power to the electric motor 18*a* to cause reverse rotation, after which the flow returns to step S215. The raising/lowering drive mechanism 18 thereby raises the auger housing 21 and the blower case 22.

When it is assessed in step S216 that the relative angle of inclination βhr has increased to the operative upper limit value βhm (βhr=βhm), or when it is assessed in step S219 that the auger housing 21 is horizontal (θh>0° or θh=0°), the flow advances to step S221.

In step S221, the raising switch element 96 is turned off, causing the electric motor 18*a* to stop and the rising of the auger housing 21 to stop, after which the subroutine is ended and the flow advances to step S23 shown in FIG. 4 described above.

As is made clear from the above description, the control unit 81 controls the raising/lowering drive mechanism 18 so that the auger housing 21 becomes horizontal (step S220), and when either of the following third and second conditions is assessed to be satisfied, the control unit executes control for stopping the raising/lowering drive mechanism 18 (step S221). The third condition is for the relative angle of inclination βhr to have increased to the operative upper limit value βhm (an assessment of NO in step S216). The second condition is that the auger housing 21 be horizontal (an assessment of NO in step S219).

The above description is summarized as follows. As shown in FIG. 7A, the auger housing 21 rises when the travel device 14 is reversing (during travel in the direction of the white arrow Ba). FIG. 7B shows a state in which the auger housing 21 has risen to a predetermined upper limit angle βhu. This action is performed by the control unit 81 (see FIG. 2) executing steps S19 to S21 shown in FIG. 4.

When the reset switch 74 (see FIG. 2) is on and the auger switch 73 (see FIG. 2) is off, the auger housing 21 lowers to the upper limit angle βhu when the travel device 14 starts to move forward (travel in the direction of the white arrow Fw) after having temporarily moved in reverse, as shown in FIG. 7B.

The control unit 81 stops the lowering action of the auger housing 21 by stopping the raising/lowering drive mechanism 18 when either of the following first and second conditions is satisfied. The first condition is that the relative angle of inclination βhr be zero. The second condition is that the auger housing 21 be horizontal, or in other words be in a horizontal position relative to the direction of gravity (θh=0°). This action is performed by the control unit 81 (see FIG. 2) executing steps S19, S20, S22, and S23 shown in FIG. 4.

For example, when the travel device 14 is traveling forward over an upward-inclined road surface Gr, the travel device takes on a front-raised orientation matching the upward-inclined road surface Gr. The auger housing 21 takes on a front-raised orientation together with the travel device 14. In this case, the raising/lowering drive mechanism 18 lowers the auger housing 21 from a front-raised orientation to a horizontal orientation. At this time, the auger housing 21 could possibly come in contact with the upward-inclined surface Gr before reaching a horizontal state.

The raising/lowering drive mechanism 18 stops the auger housing 21 when the angle βhr of the auger housing 21 relative to the travel frame 12 is zero. In other words, the raising/lowering drive mechanism 18 does not continue to drive until the auger housing 21 reaches a horizontal state. Therefore, the travel device 14 can be grounded more reliably on the upward-inclined surface Gr (the road surface Gr). Because the travel device 14 travels while reliably grounded on the upward-inclined surface Gr, the travel performance of the snow plow 10 can be increased. Moreover, because the auger housing 21 does not continue to be lowered further until reaching a horizontal state after the relative angle βhr has reached zero, the durability of the snow plow 10 can be further increased.

When the travel device 14 is traveling on a downward-inclined road surface Gr, or is in other words in a front-lowered state, the auger housing 21 is also in a front-lowered state. Therefore, the auger housing 21 rises so as to be horizontal and stops upon becoming horizontal.

The control unit 81 (see FIG. 2) then performs a control so as to either make the auger housing 21 horizontal or maintain the horizontal state by turning on the auger switch 73 (see FIG. 2). In other words, the control unit 81 controls the raising/lowering drive mechanism 18 so that the auger housing 21 reaches a horizontal position (θh=0°) relative to the direction of gravity. This action is performed by the control unit 81 executing steps S19, S20, S22, and S24 shown in FIG. 4. In this case, the control unit 81 does not control the height of the auger housing 21 so that the relative angle of inclination βhr reaches zero. Therefore, the auger housing 21 and the scraper 21*a* can be prevented from unnecessarily digging into the ground surface Gr during the snow plowing work by the auger 23.

In the present invention, the control unit 81 can set the detection signals of the height position sensor 85 as voltage signals for each degree of the detected angle of inclination βhr, and can store the voltage signals for each degree in advance in the memory 82. For example, when the auger housing 21 rises ten degrees, the voltage signal of the height position sensor 85 could change by three volts. The voltage signal of one degree would be 0.3 volts. This numerical value would be stored in advance in the memory 82.

Consider a case in which the control unit 81 executes the auto height mode shown in FIG. 4, and the snow plow 10 performs snow plowing work while traveling forward. For example, when the travel device 14 is traveling over a soft snow-covered surface, the hardness condition of the snow-covered surface could differ significantly depending on the location. The travel device 14 could suddenly tilt in the forward-backward direction by accidentally sinking into the snow-covered surface when moving onto a soft snow-covered surface from a hard snow-covered surface. When the orientation of the travel device 14 tilts with the rear lowered, the auger housing 21 also suddenly tilts in the same direction. The auger housing 21 lowers dramatically when attempting to return to a horizontal state, going lower than the travel device 14 and digging into the snow-covered surface. As a result, it is preferable that sufficient travel propulsion force be reliably provided even when the travel device 14 is elevated above the snow-covered surface.

In the present embodiment, the angles of inclination βhr detected by the height position sensor 85 are set as voltage signals for each degree and are stored in advance in the memory 82, whereby a limit can be set on the range in which the auger housing 21 can be lowered. In other words, when the control unit 81 assesses that the orientation of the travel device 14 has accidentally tilted in the forward-backward direction, the control unit can guarantee the travel propulsion force of the travel device 14 by imposing a limit so that the auger housing 21 can only be lowered to a number of degrees set in advance from the horizontal state.

The snow plow 10 of the present invention is suitable as an auger snow plow in which at least an auger 23 is driven by an engine 15.

Obviously, various minor changes and modifications of the present invention are possible in light of the above teaching. It is therefore to be understood that within the scope of the appended claims the invention may be practiced otherwise than as specifically described above.

What is claimed is:

1. A snow plow comprising a travel frame having a travel device, an auger housing having an auger and capable of being raised and lowered relative to the travel frame, a raising/ lowering drive mechanism for raising and lowering the auger housing, and a control unit for controlling the raising/lowering drive mechanism, wherein the snow plow comprises a relative angle detection unit for detecting the angle of the auger housing relative to the travel frame, and a horizontal detection unit for detecting the horizontal state of the auger housing relative to the direction of gravity, the control unit controls the raising/lowering drive mechanism so that the auger housing becomes horizontal, and the control unit performs a control so as to stop the raising/lowering drive mechanism when the control unit assess that one of a first condition and a second condition is satisfied, the first condition being that the relative angle be zero and the second condition being that the auger housing be horizontal.

* * * * *